US011313220B1

(12) United States Patent
Al-Mousa

(10) Patent No.: US 11,313,220 B1
(45) Date of Patent: Apr. 26, 2022

(54) METHODS FOR IDENTIFYING DRILL STRING WASHOUTS DURING WELLBORE DRILLING

(71) Applicant: Saudi Arabian Oil Company, Dhahran (SA)

(72) Inventor: Ahmed A. Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/177,420

(22) Filed: Feb. 17, 2021

(51) Int. Cl.
*E21B 21/08* (2006.01)
*E21B 47/11* (2012.01)

(52) U.S. Cl.
CPC ..... *E21B 47/11* (2020.05); *E21B 21/08* (2013.01)

(58) Field of Classification Search
CPC ..... E21B 47/11; E21B 21/08
See application file for complete search history.

(56) References Cited

U.S. PATENT DOCUMENTS 2,528,956 A * 11/1950 Hayward ..... E21B 47/11 73/40.5 R
2,658,724 A * 11/1953 Arps ..... E21B 47/00 175/41
4,346,594 A 8/1982 Owings
4,941,951 A 7/1990 Sheppard et al.
7,694,558 B2 4/2010 Zaeper et al.
2002/0011338 A1* 1/2002 Maurer ..... E21B 21/08 166/372
2010/0044034 A1* 2/2010 Bailey ..... E21B 47/11 166/253.1
2011/0192594 A1* 8/2011 Roddy ..... E21B 33/13 166/250.01
2012/0322695 A1* 12/2012 Kefi ..... C09K 8/502 507/118

(Continued)

FOREIGN PATENT DOCUMENTS

CA 2095583 C 8/2004
EP 572055 A1 12/1993
WO 2013192365 A1 12/2013

OTHER PUBLICATIONS

International Search Report and Written Opinion dated Oct. 15, 2021 pertaining to International application No. PCT/US2021/026098 filed Apr. 7, 2021, 12 pages.

*Primary Examiner* — Silvana C Runyan
(74) *Attorney, Agent, or Firm* — Dinsmore & Shohl, LLP

(57) ABSTRACT

A method for identifying a drill string washout during wellbore drilling includes operating a drill bit in a wellbore. The drill bit is disposed at a downhole end of a drill string. The method further includes circulating a washout detection composition through the drill string and back to a surface of the wellbore. The washout detection composition includes a carrier fluid and a detecting material that includes strings, wires, fibers, or combinations of these. The method further includes removing the drill string from the wellbore, and determining a location of the drill string washout by inspecting the drill string. The drill string washout is characterized by at least one washout opening in the drill string. The location of the at least one washout opening is identified by at least a portion of the detecting material extending through the at least one washout opening in the drill string so that the detecting material is visible from an exterior of the drill string.

19 Claims, 3 Drawing Sheets

(56) References Cited

U.S. PATENT DOCUMENTS

| | | | | |
|---|---|---|---|---|
| 2015/0184504 | A1 | 7/2015 | Ringer et al. | |
| 2016/0024906 | A1* | 1/2016 | Jamison | E21B 44/00 175/25 |
| 2020/0109605 | A1 | 4/2020 | Amoudi et al. | |

* cited by examiner

METHODS FOR IDENTIFYING DRILL STRING WASHOUTS DURING WELLBORE DRILLING

TECHNICAL FIELD

Embodiments of the present disclosure generally relate to natural resource well drilling, in particular, methods for identifying a drill string washout during wellbore drilling.

BACKGROUND

Extracting hydrocarbons from a hydrocarbon-bearing subterranean geologic formation requires drilling a hole from the surface to the subterranean geological formation housing the hydrocarbons. The wellbore is a hole that extends from the surface to a location beneath the surface to permit access to hydrocarbon-bearing subterranean formations. The wellbore contains at least a portion of a fluid conduit that links the interior of the wellbore to the surface. The fluid conduit coupling the interior of the wellbore to the surface may be capable of permitting regulated fluid flow from the interior of the wellbore to the surface. The fluid conduit may also permit access between equipment on the surface and the interior of the wellbore. The fluid conduit may be defined by one or more tubular strings, such as wellbore casings for example, inserted into the wellbore and secured in the wellbore.

Specialized drilling techniques, equipment, and materials are utilized to form the wellbore and extract the hydrocarbons. To drill a wellbore, a bottom hole assembly that includes at least a drill bit coupled to a downhole end of a drill string, may be inserted into the wellbore and the drill bit operated to further extend the wellbore into the subterranean formation. The drill bit may be operated in the presence of a drilling fluid. The drill string may be a series of interconnected pipes providing a fluid pathway from the surface to the drill bit. During drilling, drilling fluids (drilling mud) may be pumped down through the drill string to the drill bit. The drilling fluids may lubricate the drill bit and may carry rock cuttings from the drill bit back to the surface through the annular space defined between the drill string and the wellbore wall. During drilling of the wellbore, the drill string may be subjected to cyclic stresses in tension, compression, and torsion, and these can create washouts in the drill string. Undetected washouts can lead to drilling fluid loss, drill string twist off, stuck pipe problems, well control incidents, or combinations of these.

SUMMARY

Conventional methods of detecting washout conditions in a drill string include visual inspection of one or more sections of the drill string to identify the location and size of the drill string washout. Conventional methods may also include monitoring the fluid pressure in the drill string at different elevations within the drill string to identify an approximate depth of the drill string washout. Despite the availability of these conventional methods for detecting washouts in a drill string, these conventional methods can be inaccurate for determining the exact location of the drill string washouts and time-consuming. Accordingly, ongoing needs exist for methods for detecting drill string washout with improved accuracy while reducing detection time and cost.

Embodiments of the present disclosure are directed to methods for detecting drill string washouts that meet this need by detecting drill string washouts using detecting materials. The detecting materials of the present disclosure include filaments, such as wires, fibers, or strings that may be added to a carrier fluid to produce a washout detection composition. The methods of the present disclosure may include pumping the washout detection composition comprising the detection material through the drill string. Pieces of the detection material may encounter a washout opening, which may be a hole, crack, or other opening in the drill string, and at least a portion of the detecting material may extend through the washout opening in the drill string so that the detecting material may be visible from an exterior of the drill string. After passing the washout detection composition through the drill string, the drill string may be withdrawn from the wellbore and inspected. With the detecting material extending through the washout opening and visible from the exterior of the drill string, the exact number and location of the washout openings in the drill string may be easily detected with improved accuracy while reducing detection time and cost.

According one or more aspects of the present disclosure, a method for identifying a drill string washout during wellbore drilling may include operating a drill bit in a wellbore. The drill bit may be disposed at a downhole end of a drill string. The method may further include circulating a washout detection composition through the drill string and back to a surface of the wellbore. The washout detection composition may include a carrier fluid and a detecting material that includes strings, wires, fibers, or combinations of these. The method may further include removing the drill string from the wellbore, and determining a location of the drill string washout by inspecting the drill string. The drill string washout may be characterized by at least one washout opening in the drill string. The location of the at least one washout opening may be identified by at least a portion of the detecting material extending through the at least one washout opening in the drill string so that the detecting material is visible from an exterior of the drill string.

A first aspect of the present disclosure may be directed to a method for identifying a drill string washout during wellbore drilling comprising operating a drill bit in a wellbore, where the drill bit is disposed at a downhole end of a drill string. The method may further include circulating a washout detection composition through the drill string and back to a surface of the wellbore. The washout detection composition may comprise a carrier fluid and a detecting material, where the detecting material may comprise strings, wires, fibers, or combinations of these. The method may further include removing the drill string from the wellbore, and determining a location of the drill string washout by inspecting the drill string. The drill string washout may be characterized by at least one washout opening in the drill string, and the location of the at least one washout opening may be identified by at least a portion of the detecting material extending through the at least one washout opening in the drill string so that the detecting material is visible from an exterior of the drill string.

A second aspect of the present disclosure may include the first aspect, where circulating the washout detection composition through the drill string may comprise pumping the washout detection composition into the drill string at the surface of the wellbore, where the washout detection composition travels downhole through the drill string, through the drill bit, and back to the surface through a return line.

A third aspect of the present disclosure may include either one of the first or second aspects, where circulating the washout detection composition through the drill string may comprise pumping a first volume of the washout detection composition through the drill string, and pumping a second volume of the washout detection composition through the drill string, where a time period between the first volume and the second volume may be from 3 minutes to 10 minutes.

A fourth aspect of the present disclosure may include any one of the first through third aspects, where determining the location of the drill string washout may comprise identifying the detecting material exposed in an outer diameter of the drill string.

A fifth aspect of the present disclosure may include any one of the first through fourth aspects, where a diameter of the detecting material may be from 0.08 mm to 5 mm.

A sixth aspect of the present disclosure may include any one of the first through fifth aspects, where a length of the detecting material may be from 30 mm to 50 mm.

A seventh aspect of the present disclosure may include any one of the first through sixth aspects, where the detecting material may comprise synthetic materials, natural materials, or both.

An eighth aspect of the present disclosure may include any one of the first through seventh aspects, where the detecting material may comprise the synthetic materials and the synthetic materials may comprise nylon, polyester, polypropylene, or combinations thereof.

A ninth aspect of the present disclosure may include any one of the first through eighth aspects, where the detecting material may comprises the natural materials and the natural materials may comprise hemp, jute, wool, cotton, sisal, seagrass, or combinations thereof.

A tenth aspect of the present disclosure may include any one of the first through ninth aspects, where the detecting material may comprise manila rope.

An eleventh aspect of the present disclosure may include any one of the first through tenth aspects, where the detecting material may comprise nylon wires having a diameter of from 0.08 mm to 0.1 mm.

A twelfth aspect of the present disclosure may include any one of the first through eleventh aspects, where the detecting material may comprise nylon strings comprising one or more filaments coupled together at at least one point along a length of the nylon string.

A thirteenth aspect of the present disclosure may include any one of the first through twelfth aspects, further comprising circulating the washout detection composition through the drill string at a flow rate of from 200 GPM (45.4 $m^3/h$) to 400 GPM (90.8 $m^3/h$).

A fourteenth aspect of the present disclosure may include any one of the first through thirteenth aspects, where the carrier fluid may comprise drilling mud, viscous brine, or combinations of these.

A fifteenth aspect of the present disclosure may include any one of the first through fourteenth aspects, where the washout detection composition may comprise from 1 wt. % to 50 wt. % the detecting material based on total weight of the washout detection composition passed to the drill string.

A sixteenth aspect of the present disclosure may include any one of the first through fifteenth aspects, further comprising recovering the washout detection composition from the wellbore, and separating a remaining portion of the detecting material from the washout detection composition for recycling.

A seventeenth aspect of the present disclosure may include any one of the first through sixteenth aspects, further comprising monitoring a wellbore drilling operating condition, and identifying a change in the wellbore drilling operating condition indicative of a drill string washout, where the circulating of the washout detection composition through the drill string may be conducted in response to identifying a change in the wellbore drilling operating condition indicative of a drill string washout.

An eighteenth aspect of the present disclosure may include the seventeenth aspect, where the operating condition may comprise a pressure drop, a flow rate, a temperature, a pressure, a viscosity, or combinations thereof, of drilling fluids circulated through the drill string during operation of the drill bit.

A nineteenth aspect of the present disclosure may include any one of the first through eighteenth aspects, where the detecting material comprises nylon strings having a diameter of from 3 mm to 5 mm and a length of from 30 mm to 50 mm, where the washout detection composition comprises from 1 wt. % to 50 wt. % the detecting material based on total weight of the washout detection composition passed to the drill string, and where the carrier fluid comprises drilling mud, viscous brine, or combinations of these.

A twentieth aspect of the present disclosure may be directed to a method for identifying a drill string washout during wellbore drilling comprising operating a drill bit in a wellbore, where the drill bit is disposed at a downhole end of a drill string. The method may further include circulating a washout detection composition through the drill string and back to the surface of the wellbore. The washout detection composition may comprise a carrier fluid and a detecting material, where the detecting material may comprise nylon strings having a diameter of from 3 mm to 5 mm and a length of from 30 mm to 50 mm. The washout detection composition may comprise from 1 weight percent (wt. %) to 50 wt. % the detecting material based on total weight of the washout detection composition passed to the drill string. The carrier fluid may comprise drilling mud, viscous brine, or combinations of these. The method may further include removing the drill string from the wellbore, and determining a location of the drill string washout by inspecting the drill string. The drill string washout may be characterized by at least one washout opening in the drill string, and the location of the at least one washout opening may be identified by at least a portion of the detecting material extending through the at least one washout opening in the drill string so that the detecting material is visible from an exterior of the drill string.

Additional features and advantages of the described embodiments will be set forth in the detailed description which follows, and in part will be readily apparent to those skilled in the art from that description or recognized by practicing the described embodiments, including the detailed description which follows as well as the drawings and the claims.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Figure 1:
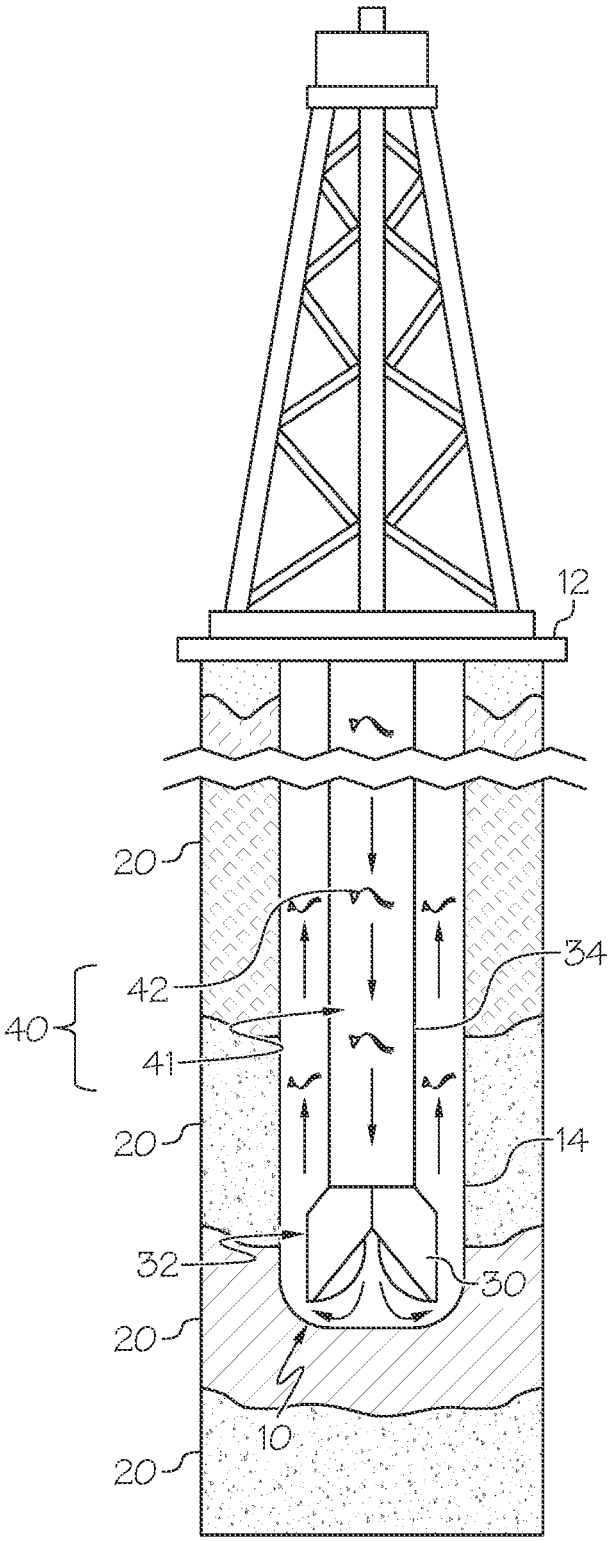
FIG. 1 schematically depicts a bottom hole assembly for drilling a wellbore, according to one or more embodiments shown and described in this disclosure.
Figure 5:
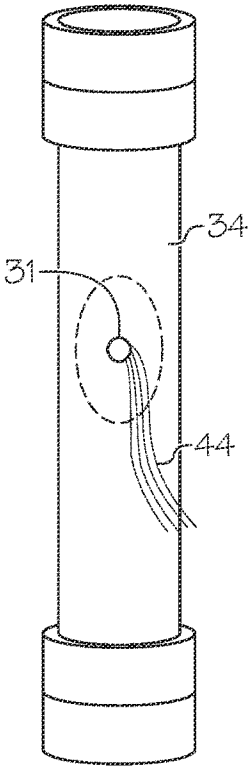
FIG. 5 schematically depicts detecting materials extending through a washout opening in a section of the drill string of FIG. 4, according to one or more embodiments shown and described in this disclosure.
Figure 6:
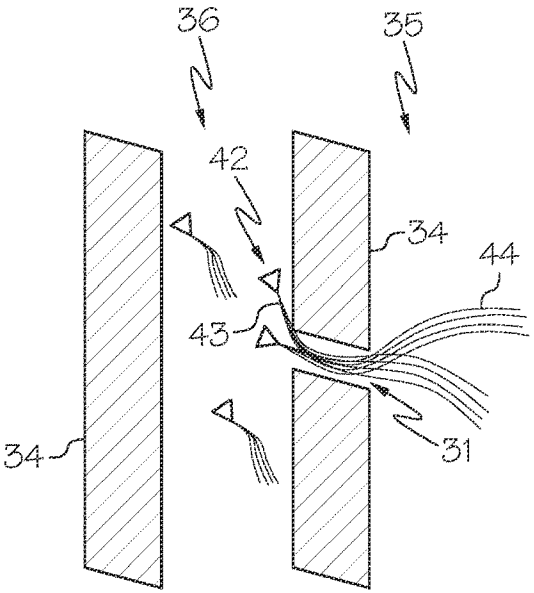
FIG. 6 schematically depicts a cross-sectional view of a wall of the drill string of FIG. 4 having a washout and a plurality of pieces of the detecting material extending through the washout location, according to one or more embodiments shown and described in this disclosure.

Embodiments of the present disclosure are directed to methods for detecting washouts in the drill string during drilling of a wellbore. Referring now to FIG. 1, the methods of the present disclosure for detecting drill string washouts in a drill string 34 may include operating a drill bit 30 in a wellbore 10. The drill bit 30 is disposed at a downhole end 32 of the drill string 34. The method may further include circulating a washout detection composition 40 through the drill string 34 and back to the surface 12 of the wellbore 10. The washout detection composition 40 may include a carrier fluid 41 and a detecting material 42 that includes strings, wires, fibers, or combinations of these. The method may further include removing the drill string 34 from the wellbore 10, and determining a location of the drill string washout by inspecting the drill string 34. Referring to FIGS. 5-6, the drill string washout may be characterized by at least one washout opening 31 extending through a wall of the drill string 34. The location of the at least one washout opening 31 may be identified by at least a portion of the detecting material 42 extending through the at least one washout opening 31 in the drill string 34 that comprise the drill string washout so that the detecting material 42 may be visible from an exterior 35 of the drill string 34. Penetration of the detecting material 42 through the washout openings 31 may enable detection and location of the drill string washout in a reduced time with improved accuracy compared to conventional methods, such as but not limited to visual detection without detecting materials, or pressure monitoring. Other features and benefits of the present disclosure may become apparent to persons of ordinary skill of the art from practicing the subject matter of the present disclosure.

As used throughout this disclosure, the term "hydrocarbon-bearing formation" may refer to a subterranean geologic region containing hydrocarbons, such as crude oil, hydrocarbon gases, or both, which may be extracted from the subterranean geologic region. The terms "subterranean formation" or just "formation" may refer to a subterranean geologic region that contains hydrocarbons or a subterranean geologic region proximate to a hydrocarbon-bearing formation, such as a subterranean geologic region to be treated for purposes of enhanced oil recovery or reduction of water production.

As used throughout this disclosure, the term "surface of the wellbore" may refer to the surface 12 of the earth in FIG. 1, where the wellbore extends downward from the surface 12 into the earth to one or more subterranean formations.

As used throughout this disclosure, the term "drill string washout" may refer to the presence of an opening, such as a crack, hole, or other opening, in a drill string that may cause fluids within the drill string to leak through the drill string out into the wellbore. The drill string washout may be caused, in some cases, by a greater pressures of the drilling fluid in the drill string.

As used throughout this disclosure, the term "fluid" can include liquids, gases, or both and may include solids in combination with the liquids, gases, or both, such as but not limited to suspended solids in the wellbore fluids, entrained particles in gas produced from the wellbore, drilling fluids comprising weighting agents, or other mixed phase suspensions, slurries and other fluids. As used throughout the present disclosure, the term "carrier fluid" may refer to any suitable fluid used in circulating detecting materials through a drill string.

As used throughout this disclosure, the term "drilling fluid" may refer to any suitable fluids, and/or mixtures of fluids and solids (e.g., solid suspensions, mixtures and emulsions of liquids, etc.) used in operations to drill wellbores in subterranean formations. In some instances, a drilling fluid may be an aqueous-based fluid that comprises clays, polymers, or both. During the drilling of a wellbore in a subterranean formation, a drilling fluid may be used to, among other things, remove generated rock cuttings, cool the drill bit, lubricate the rotating drill string to prevent it from sticking to the walls of the wellbore, prevent blowouts by serving as a hydrostatic head to counteract the sudden entrance into the wellbore of high pressure formation fluids, and remove drill cuttings from the wellbore.

As used throughout this disclosure, the term "synthetic materials" may refer to artificial materials produced by chemical synthesis. As used throughout this disclosure, the term "natural materials" may refer to any materials that are extracted from plants, animals, or the ground.

As used throughout this disclosure, the terms "uphole" and "downhole" may refer to a position within a wellbore relative to the surface of the wellbore, with "uphole" indicating direction or position closer to the surface of the wellbore and "downhole" referring to direction or position farther away from the surface of the wellbore.

Referring to FIG. 1, a wellbore 10 extending from the surface 12 of the wellbore 10 into a subterranean formation 20 is schematically depicted. The wellbore 10 forms a pathway capable of permitting both fluids and apparatus to traverse between the surface 12 and a hydrocarbon-bearing subterranean formation 20. Besides defining the void volume of the wellbore 10, the wellbore wall 14 also acts as the interface through which fluid can transition between the subterranean formation 20 and the interior of the wellbore 10. The wellbore wall 14 can be unlined (that is, bare rock or formation) to permit such interaction with the formation 20 or lined, such as by a tubular string, so as to prevent, reduce, or control such interactions. During drilling of the wellbore 10, the portion of the wellbore 10 being drilled is generally unlined until the drill string 34 can be pulled and tubular strings can be positioned in the wellbore 10 and cemented in place.

The wellbore 10 may include at least a portion of a fluid conduit that links the interior of the wellbore 10 to the surface 12. The fluid conduit connecting the interior of the wellbore 10 to the surface 12 may be capable of permitting regulated fluid flow from the interior of the wellbore 10 to the surface 12 and may permit access between equipment on the surface 12 and the interior of the wellbore 10. Example equipment connected at the surface 12 to the fluid conduit may include but is not limited to pipelines, tanks, pumps, compressors, and flares. The fluid conduit may be large enough to permit introduction and removal of mechanical devices, including but not limited to tools, drill strings, sensors, instruments, inflow control devices, or combinations of these into and out of the interior of the wellbore 10.

The wellbore 10 may be drilled using a drill bit 30 in the presence of a drilling fluid. The drill bit 30 may be coupled to a downhole end 32 of a drill string 34, which comprises a length of interconnected piping. During operation of the drill bit 30, the drilling fluid is typically pumped through the interconnected pipe of the drill string 34 to the drill bit 30. The drilling fluids enter the wellbore 10 through the drill bit 30 and flow back through the wellbore 10 to the surface 12, in particular through the annular space between the wellbore 10 and the drill string 34 in the uphole direction from the drill bit 30 towards the surface 12. Drilling fluids are formulated to have rheological properties that enable the drilling fluid to convey cuttings from the drill bit 30 back to the surface 12 of the wellbore 10. The drilling fluid and cuttings may also form a mudcake on the wellbore walls 14 that reduces the permeability of the wellbore walls 14 to reduce fluid communication between the wellbore 10 and the subterranean formation 20.

Figure 4:
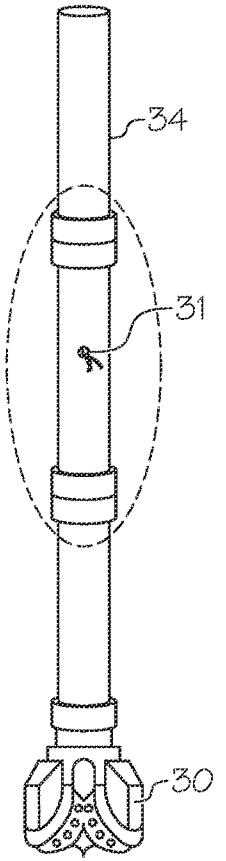
FIG. 4 schematically depicts a front view of the drill string of FIG. 1 when a washout detection composition is circulated through the drill string, according to one or more embodiments shown and described in this disclosure.

Referring to FIGS. 1 and 4, while drilling the wellbore 10, the drill string 34 may be subjected to tensile stress, corrosion, erosion, or combinations of these caused by the flow of the drilling fluids through the drill string 34. These tensile stresses, corrosion, or erosion can cause washouts in a drill string 34. Drill string washouts can be characterized by one or more washout openings 31 that develop in the wall of the drill string 34. These washout openings 31 allow fluid communication between the fluid pathway of the drill string 34 and the annular space between the drill string 34 and the wellbore wall. These washout openings 31 in the drill string 34 may allow fluids from the drill string 34 to flow out into the wellbore 10, which results in decreased fluid pressure and flow rate through the drill string 34. Drill string washout refers to this condition of drilling fluids or other fluids flowing through washout openings 31 in the drill string 34 resulting in reduction in fluid pressure and flow rate in the drill string 34.

Conventional methods for detecting drill string washouts may include visual inspection, where the drill string is removed from the wellbore and inspected for openings or holes causing the washout. Other conventional methods of detecting drill string washouts may include but are not limited to monitoring the pressure in the drill string or wellbore at various depths to determine an approximate location of the washout. Other conventional techniques for determining and locating drill string washouts are also available. While these conventional methods are available for detecting these washouts, these methods may have a greater risk of incomplete or inaccurate detections of the locations of the washout openings causing the drill string washouts. Further, conventional washout detection methods may be time-consuming and costly.

The present disclosure is directed to methods for identifying a drill string washout during wellbore drilling. In particular, the methods of the present disclosure include circulating a washout detection composition, which comprises a detection material in a carrier fluid, through the drill string. The detection material may penetrate through the washout openings in the drill string to identify the location of the washout openings. The methods of the present disclosure may detect drill string washouts with improved accuracy while reducing detection time and cost.

Referring to FIGS. 1-6, the methods for detecting drill string washouts will be described in further detail. The methods for detecting drill string washout may include operating a drill bit 30 in a wellbore 10. The drill bit 30 may be disposed at a downhole end 32 of a drill string 34. The drill string 34 may be inserted into the wellbore 10. To drill the wellbore 10, the drill string 34 may be inserted into a predrilled hole and rotated to cause the drill bit 30 to cut into the rock at the bottom of the hole. The drilling operation produces rock fragments. To remove the rock fragments from the bottom of the wellbore 10, a drilling fluid may be pumped down through the drill string 34 to the drill bit 30. The drilling fluid may cool the drill bit 30, provide lubrication to the drill bit 30, lift the rock fragments known as cuttings away from the drill bit 30, or combinations of these. The drilling fluid may carry the cuttings upwards as the drilling fluid is re-circulated back to the surface 12 through the annular space defined between the drill string 34 and the wellbore wall 14. At the surface 12, the cuttings may be removed from the drilling fluid through a secondary operation, and the drilling fluid may be re-circulated back down through the drill string 34 to the bottom of the wellbore 10 for collection of further cuttings.

Referring again to FIG. 1, the methods of the present disclosure may further include circulating a washout detection composition 40 through the drill string 34 and back to the surface 12. As used herein, the term "washout detection composition" may refer to any suitable mixtures of fluids and solids for detecting washouts in a drill string. The washout detection composition 40 may detect the location, size, depth, or combinations thereof, of washout openings 31 in the drill string 34. The washout detection composition 40 may include a carrier fluid 41 and a detecting material 42 dispersed in the carrier fluid 41. The term "detecting material" may refer to any solids suitable for detecting washout openings 31 in a drill string 34. The washout detection composition 40 may optionally include one or more additives.

The detecting materials 42 may have dimensions that enable at least a portion of the detecting materials 44 to encounter and penetrate through the washout openings 31 so that at least a portion of the detecting material 44 is visible on the outer surface of the drill string 34 to mark the location of the washout opening 31. The detecting materials 42 may be characterized by an outside diameter and a length. The detecting materials 42 may have an outside diameter that is less than a diameter of a washout opening 31 that is large enough to influence the pressure or flow rate of drilling fluids flowing through the drill string 34. The detecting materials 42 may have an average outside diameter of greater than or equal to 0.08 millimeters (mm), greater than or equal to 0.1 mm, greater than or equal to 0.5 mm, or even greater than or equal to 1 mm. When the average outside diameter is less than about 0.08, the detecting materials 42 may pass through the washout openings 31 completely without getting stuck and being visible from the exterior 35 of the drill string 34. The detecting materials 42 may have an average outer diameter that is less than or equal to 5 mm, less than or equal to 4 mm, less than or equal to 3 mm, or less than or equal to 2 mm. When the average outer diameter of the detecting material 42 is greater than or equal to 5 mm, the detecting materials 42 may be too large to penetrate through the washout openings 31 to the extent necessary for the detecting material 42 to be visible from the exterior 35 of the drill string. This may reduce the probability of detecting smaller washout openings 31 less than about 10 mm, or less than about 5 mm. The detecting material 42 may have an average outside diameter of from 0.08 millimeters (mm) to 5 mm, from 0.08 mm to 4 mm, from 0.08 mm to 3 mm, from 0.08 mm to 2 mm, from 0.08 mm to 1 mm, from 0.08 mm to 0.5 mm, from 0.08 mm to 0.1 mm, from 0.1 mm to 5 mm, from 0.1 mm to 4 mm, from 0.1 mm to 3 mm, from 0.1 mm to 2 mm, from 0.1 mm to 1 mm, from 0.5 mm to 5 mm, from 0.5 mm to 4 mm, from 0.5 mm to 3 mm, from 0.5 mm to 2 mm, from 0.5 mm to 1 mm, from 1 mm to 5 mm, from 1 mm to 4 mm, from 1 mm to 3 mm, from 1 mm to 2 mm, from 2 mm to 5 mm, or from 2 mm to 4 mm.

In embodiments, the detecting material 42 may include nylon wires having an average outer diameter of from 0.08 mm to 5 mm, from 0.08 mm to 4 mm, from 0.08 mm to 3 mm, from 0.08 mm to 2 mm, from 0.08 mm to 1 mm, from 0.08 mm to 0.5 mm, or from 0.08 mm to 0.1 mm. In embodiments, the detecting material 42 may include the nylon strings having an average outer diameter of from 3 mm to 5 mm, from 3 mm to 4.8 mm, from 3 mm to 4.6 mm, from 3 mm to 4.4 mm, from 3 mm to 4.2 mm, or from 3 mm to 4 mm.

The detecting material 42 may be a flexible elongated solid material having one or more filaments capable of encountering and passing through a washout opening 31 in the drill string 34. The detecting material 42 may include a plurality of individual strings, wires, fibers, or combinations of these. As used herein, the term "string" may refer to a structure comprising a plurality of filaments woven together or consolidated into a single strand. The term "wire" may refer to a structure comprising a single or multiple filaments. The term "fiber" may refer to a structure comprising a single filament or thread. The detecting material 42 may include synthetic materials, natural materials, or both. When the detecting material 42 includes the synthetic materials, the synthetic materials may include but are not limited to nylon, polyester, polypropylene, or combinations thereof. In embodiments, the detecting material 42 may be a synthetic material selected from the group consisting of nylon, polypropylene, and both. When the detecting material 42 includes the natural materials, the natural materials may include but are not limited to hemp, jute, wool, cotton, sisal, seagrass, or combinations of these materials. In embodiments, the detecting material 42 may be a natural material selected from the group consisting of hemp, jute, wool, cotton, sisal, seagrass, and combinations of these. In embodiments, the detecting material 42 may include natural fibers. The detecting material 42 may include manila rope. The term "manila rope" may refer to a type of rope made from manila hemp. The term "manila hemp" may refer to a type of fiber obtained from the leaves of the abacá plant.

The detecting material 42 may have an average length sufficient so that only a portion of the detecting material 42 may penetrate through the washout opening 31 and the piece of detecting material 42 does not pass all the way through the washout opening 31. The detecting material 42 may have an average length sufficient so that the detecting material 42 can become stuck in the washout opening 31 without passing all the way through the washout opening 31. The detecting material 42 may have an average length that is greater than a thickness of the wall of the drill string 34. A ratio of the average length of the detecting material 42 to the average thickness of the wall of the drill string 34 may be greater than or equal to 2, greater than or equal to 3, or even greater than or equal to 4, such as from 2 to 20, from 2 to 10, from 2 to 5, from 3 to 20, from 3 to 10, from 3 to 5, from 5 to 20, or from 5 to 10. The detecting material 42 may have an average length of greater than or equal to 30 mm, greater than or equal to 32 mm, greater than or equal to 35 mm, or even greater than or equal to 40 mm. When the average length of the detecting materials 42 is less than about 30 mm, the detecting materials 42 may not be long enough to penetrate through the washout opening 31 far enough to be visible to the human eye from the outside of the drill string 34. The detecting material 42 may have a length less than or equal to 50 mm, less than or equal to 48 mm, or even less than or equal to 45 mm. When the average length of the detecting materials 42 is greater than about 50 mm, the washout detection composition 40 may be difficult to circulate through the drill string 34. The detecting materials 42 may have an average length of from 30 mm to 50 mm, from 30 mm to 48 mm, from 30 mm to 45 mm, from 30 mm to 40 mm, from 32 mm to 50 mm, from 32 mm to 48 mm, from 32 mm to 45 mm, from 32 mm to 40 mm, from 35 mm to 50 mm, from 35 mm to 48 mm, from 35 mm to 45 mm, from 35 mm to 40 mm, from 40 mm to 50 mm, from 40 mm to 48 mm, or from 45 mm to 50 mm.

Figure 2:
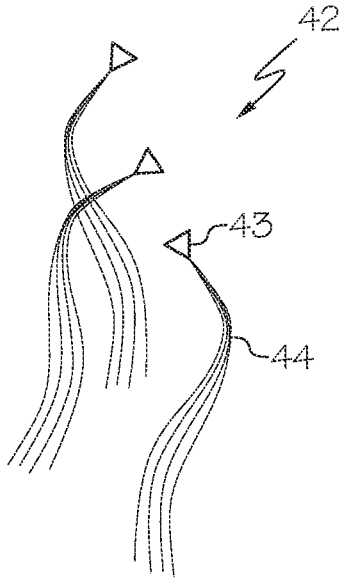
FIG. 2 schematically depicts detecting materials, according to one or more embodiments shown and described in this disclosure.

In embodiments, the detecting material 42 may include nylon strings. The nylon strings may include one or more filaments coupled together at at least one point along a length of the nylon string. Referring to FIG. 2, the nylon strings may include one or two strands 43 with multiple nylon wires 44. The strand 43 may have a cross-sectional shape that is a circle, ellipse, triangle, square, rectangle, pentagon, hexagon, heptagon, octagon, or irregular shaped. Each of the detecting materials 42 may include a plurality of wires or strings 44 coupled together at one point along the wire or string 44. In embodiments, the detecting materials 42 may include a plurality of nylon wires 44 coupled together at one end. In embodiments, the detecting materials 42 may include a string comprising a plurality of filaments, fibers or wires 44, where the string is at least partially unwoven at one end so that at least a portion of the filaments, fibers or wires 44 of the string are free to independently encounter the washout openings 31.

Figure 3:
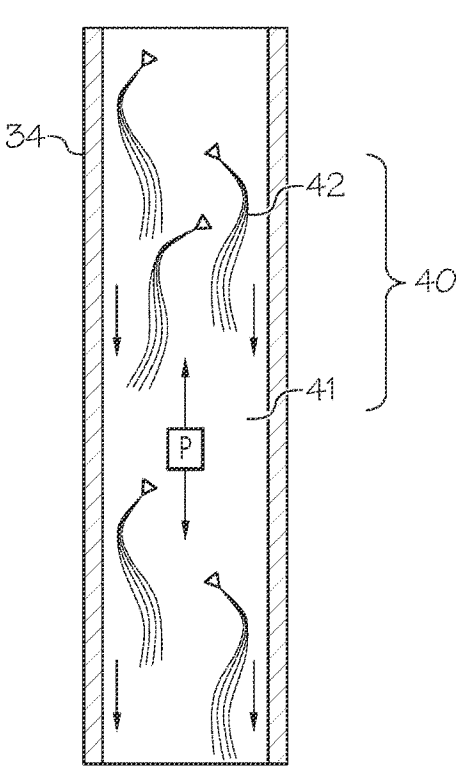
FIG. 3 schematically depicts a cross-sectional view of the drill string of FIG. 1 when a washout detection composition is circulated through the drill string, according to one or more embodiments shown and described in this disclosure.

Referring now to FIG. 3, the washout detection composition 40 may be circulated through the drill string 34. Detecting material 42 in the washout detection composition 40 may pass through the drill string 34. Detecting materials 42 may contact the walls of the drill string 34 as they pass through the drill string 34. Referring to FIG. 4, at least a portion of the detecting materials 42 (FIG. 3) may encounter and penetrate through the washout openings 31 in the wall of drill string 34 as they pass through the drill string 34. The detecting material 42 (FIG. 3) may be stuck into the washout openings 31 in the drill string 34. Referring now to FIG. 5, at least a portion of the detecting material 42 may be extended through the washout openings 31 in the drill string 34. In embodiments, a portion of the filaments 44 of the detecting material 42 may be extended through the washout opening 31 in the drill string 34. The piece of detecting material 42 does not pass all the way through the washout opening 31. The remaining portion of the detecting material 42, such as a strand 43, and the remaining portion of the detecting material filaments 44, may be placed in the interior 36 (FIG. 6) of the drill string 34. Referring to FIG. 6, at least a portion of the detecting material 42 is exposed in an outer diameter of the drill string 34. A portion of the filaments 44 of the detecting material 42 may be extended through the washout opening 31 in the drill string 34 so that the detecting material 42 is visible to the human eye from an exterior 35 of the drill string 34. Thus, the washout openings 31 may be detected and located through visual inspection of the exterior 35 of the drill string 34. With the detecting material 34 extending through the washout location and visible from the exterior 35 of the drill string 34, the exact location of the washout opening 31 in the drill string 34 may be easily detected with improved accuracy while reducing detection time and cost.

Referring to FIGS. 1-6, the method may further include removing the drill string 34 from the wellbore 10 to inspect the drill string 34. The drill string 34 may be pulled out from the wellbore 10 for inspection and detection of the location and size of any washout openings 31. The removed drill string 34 may be inspected to determine a size, a location, a number, or combinations thereof, of the washout openings 31 in the drill string 34. The "size" of the washout opening 31 may refer to an average diameter of the washout opening 31. The "location" of the washout opening 31 may refer to the axial and angular position of the washout opening 31 on the drill string 34. The drill string washout openings 31 may be detected by identifying the detecting material 42 exposed in an outer diameter of the drill string 34 through visual inspection of the exterior 35 of the drill string 34. The detecting materials 42 may be stuck through the washout openings 31 in the drill string 34. The detecting material 42 may be stuck into the washout openings 31 in the drill string 34, due to shape, size, or both, of the detecting material 42. The location of the washout openings 31 may be identified by at least a portion of the detecting material 42 extending through the opening 31 in the drill string 34 so that the detecting material 42 is visible to the human eye from an exterior 35 of the drill string 34. With the detecting material 42 visible from the exterior 35 of the drill string 34, the method of the present disclosure may detect washout openings 31 with improved accuracy and reduced detection time, compare to detecting washouts 31 without the detecting material 42.

Referring back to FIGS. 1-6, the washout detection composition 40 may include the carrier fluid 41. The carrier fluid 41 may be a fluid having sufficient viscosity to suspend and carry the detecting materials 42 through the drill string. The carrier fluid 41 may have a viscosity of from 50 seconds to 80 seconds, from 50 seconds to 75 seconds, from 50 seconds to 70 seconds, from 55 seconds to 80 seconds, from 55 seconds to 75 seconds, from 55 seconds to 70 seconds, from 60 seconds to 80 seconds, from 60 seconds to 75 seconds, or from 60 seconds to 70 seconds. The viscosity may be Funnel Viscosity (FV), which is measured the time, in seconds for one quart of mud to flow through a Marsh funnel. The carrier fluid 41 may include, but is not limited to drilling mud, viscous brine, or combinations of these. The washout detection composition 40 may include any other additives commonly included in wellbore fluids. Additives may include but are not limited to viscosifiers, weighting agents, surfactants, emulsifiers, scale inhibitors, other drilling fluid additive, or combinations of these.

The washout detection composition 40 may include a concentration of the detecting materials 42 sufficient for the detecting materials 42 to encounter the washout openings 31 in the drill string 34. If the concentration of the detecting materials 42 is not sufficient, the detecting materials 42 may pass through the drill string 34 without encountering the washout openings 31. If the concentration of the detecting materials 42 in the washout detection composition 40 is too great, the washout detection composition 40 may be difficult to circulate through the drill string 34, which may cause stuck pipe problems or clogging of pumps or other equipment. The washout detection composition 40 may include greater than or equal to 1 weight percent (wt. %), greater than or equal to 5 wt. %, or even greater than or equal to 10 wt. % detecting material 42 based on the total weight of the washout detection composition 40. The washout detection composition 40 may include less than or equal to 50 wt. %, less than or equal to 40 wt. % or even less than 30 wt. % detecting materials 42 based on the total weight of the washout detection composition 40. The washout detection composition 40 may include from 1 wt. % to 50 wt. %, from 1 wt. % to 40 wt. %, from 1 wt. % to 30 wt. %, from 1 wt. % to 10 wt. %, from 1 wt. % to 5 wt. %, from 5 wt. % to 50 wt. %, from 5 wt. % to 40 wt. %, from 5 wt. % to 30 wt. %, from 5 wt. % to 10 wt. %, from 10 wt. % to 50 wt. %, from 10 wt. % to 40 wt. %, from 10 wt. % to 30 wt. %, from 30 wt. % to 50 wt. %, from 30 wt. % to 40 wt. %, or from 40 wt. % to 50 wt. % detecting materials 42 per unit weight of the washout detection composition 40 passed to the drill string 34.

In embodiments, the detecting material 42 includes nylon strings dispersed in the carrier fluid 41 that comprises drilling mud, viscous brine, or combinations of these, where the nylon strings have an average outer diameter of from 3 mm to 5 mm and an average length of from 30 mm to 50 mm and the washout detection composition 40 may include from 1 wt. % to 50 wt. % the detecting material 42 based on a unit weight of the washout detection composition 40 passed to the drill string 34. In embodiments, the detecting material 42 includes nylon wires dispersed in the carrier fluid 41 that comprises drilling mud, viscous brine, or combinations of these, where the nylon wires have an average outer diameter of from 0.08 mm to 0.5 mm and an average length of from 30 mm to 50 mm and the washout detection composition 40 may include from 1 wt. % to 50 wt. % the detecting material 42 based on a unit weight of the washout detection composition 40 passed to the drill string 34. In embodiments, the washout detection composition 40 may consist of or consist essentially of the detecting material 42 and the carrier fluid 41. In embodiments, the washout detection composition 40 does not include additives other than the detecting materials 42 and the carrier fluid 41.

In some embodiments, the washout detection composition 40 may have a viscosity of from 20 centipoise (cP) (0.02 pascal·second (Pa·s)) to 40 cP (0.04 Pa·s), from 20 cP (0.02 Pa·s) to 35 cP (0.035 Pa·s), from 20 cP (0.02 Pa·s) to 30 cP (0.03 Pa·s), from 25 cP (0.025 Pa·s) to 40 cP (0.04 Pa·s), from 25 cP (0.025 Pa·s) to 35 cP (0.035 Pa·s), or from 25 cP (0.025 Pa·s) to 30 cP (0.03 Pa·s). The viscosity may be measured at a shear rate of 511 and 1022 $s^{-1}$ measured at 122° C. flow line temperature at atmospheric pressure.

The methods of the present disclosure may include preparing the washout detection composition 40 prior to circulating the washout detection composition 40 through the drill string 34. The washout detection composition 40 may be prepared by combining the detecting material 42 with the carrier fluid 41 and mixing the components to produce the washout detection composition 40. The washout detection composition 40 may be prepared by known methods of preparing a slurry comprising solids dispersed in a fluid.

Referring again to FIG. 1, circulating the washout detection composition 40 through the drill string 34 may include pumping the washout detection composition 40 into the drill string 34 at the surface 12. During circulation, the washout detection composition 40 may travel downhole through the drill string 34, through the drill bit 30, and back uphole to the surface 12 through a return line. In embodiments, the washout detection composition 40 may be combined with the drilling fluid and circulated through the drill string 34 with the drilling fluid. In other embodiments, the washout detection composition 40 may be separated from the drilling fluid using a spacer fluid, which may be pumped into the drill string 34 after the drilling fluid and before washout detection composition 40. The washout detection composition 40 may be circulated through the drill string 34 separate from the drilling fluid.

The washout detection composition 40 may be circulated through the drill string 34 at a flow rate sufficient to enable at least some of the detecting materials 42 to encounter the washout openings 31 and penetrate at least partially through the washout opening 31. In some embodiments, the washout detection composition 40 may be circulated through the drill string 34 at a flow rate of from 200 Gallons Per Minute (GPM) (45.4 $m^3$/h) to 400 GPM (90.8 $m^3$/h), from 200 GPM (45.4 $m^3$/h) to 380 GPM (86.3 $m^3$/h), from 200 GPM (45.4 $m^3$/h) to 350 GPM (79.5 $m^3$/h), from 220 GPM (50.0 $m^3$/h) to 400 GPM (90.8 $m^3$/h), from 220 GPM (50.0 $m^3$/h) to 380 GPM (86.3 $m^3$/h), from 220 GPM (50.0 $m^3$/h) to 350 GPM (79.5 $m^3$/h), from 250 GPM (56.8 $m^3$/h) to 400 GPM (90.8 $m^3$/h), from 250 GPM (56.8 $m^3$/h) to 380 GPM (86.3 $m^3$/h), or from 250 GPM (56.8 $m^3$/h) to 350 GPM (79.5 $m^3$/h). The washout detection composition 40 may be circulated through the drill string 34 at the temperature of the wellbore 10. The washout detection composition 40 may be circulated through the drill string 34 at a pressure sufficient to transport the washout detection composition 40 through the drill string 34 and back to the surface 12 at the target flow rate.

In embodiments, the circulation step may include pumping a first volume of the washout detection composition 40 through the drill string 34, and pumping a second volume of the washout detection composition 40 through the drill string 34. In some embodiments, a time period (P in FIG. 3) between the first volume of the washout detection composition 40 and the second volume of the washout detection composition 40 may be from 3 minutes (mins) to 10 mins, from 3 mins to 8 mins, from 5 mins to 10 mins, or from 5 mins to 8 mins.

Still referring to FIGS. 1-6, the method may further include recovering the washout detection composition 40 from the wellbore 10. A portion of the detecting material 42 may be stuck into the drill string washout opening 31, and a remaining portion of the detecting material 42 may be returned to the surface 12 through the return line with the carrier fluid 41. The remaining portions of the detecting material 42 may be separated from the washout detection composition 40 so that the detecting materials 42 can be reused in subsequent washout detection treatments. The remaining portion of the detecting material 42 may be combined with the carrier fluid 41 and then circulated through the drill string 34.

The method may further include monitoring a wellbore drilling operating condition, and identifying a change in the wellbore drilling operating condition indicative of a drill string washout. The circulating of the washout detection composition 40 through the drill string 34 may be conducted in response to identifying a change in the wellbore drilling operating condition indicative of a drill string washout. The drilling operating condition may be measured by one or more sensors, such as but not limited to pressure or flow rate sensors, positioned in the drill string 34, in the wellbore 10, in the return line, at the surface 12, or combinations of these. In embodiments, the drilling operating condition may be measured and monitored by a plurality of pressure sensors, flow rate sensors, or both positioned along the length of the drill string 34. The existence of washout openings 31 in the drill string 34 may be identified by identifying increases or decreases in the drilling operating condition.

In embodiments, the drilling operating condition may include a pressure drop, a flow rate, a temperature, a pressure, a viscosity, or combinations thereof, of drilling fluids circulated through the drill string 34 during operation of the drill bit 30. In response to identifying a change in the drilling operating condition, the washout detection composition 40 may be prepared and circulated through the drill string 34. The drill string 34 may then be pulled out from the wellbore 10 and inspected to determine a size, a location, a number, or combinations thereof, of the drill string washout openings 31. Once the size, location, and number of washout openings 31 are determined, the drill string 34 can be repaired or replaced to remediate the washout openings 31. The drill string 34 may be repaired by covering the washout opening 31 with a patch or sleeve or by replacing the section of interconnected pipe of the drill string 34 comprising the washout opening 31 with a section of interconnected pipe that does not have washout openings 31.

In embodiments, the drilling operating condition may be changed around the location of washout openings 31. In response to identifying a change in the drilling operating condition, the drill string 34 may be pulled out from the wellbore 10, and then the location of washout openings 31 may be detected with reduced downtime and cost and improved accuracy compared to conventional washout detection methods.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

It is noted that one or more of the following claims utilize the terms "where," "wherein," or "in which" as transitional phrases. For the purposes of defining the present technology, it is noted that these terms are introduced in the claims as an open-ended transitional phrase that are used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A method for identifying a drill string washout during wellbore drilling, the method comprising:

operating a drill bit in a wellbore, where the drill bit is disposed at a downhole end of a drill string;

identifying that a drill string washout has occurred by monitoring a wellbore drilling operating condition;

circulating a washout detection composition through the drill string and back to a surface of the wellbore, the washout detection composition comprising a carrier fluid and a detecting material, where the detecting material comprises strings, wires, fibers, or combinations of these;

removing the drill string from the wellbore; and determining a location of the drill string washout by inspecting the drill string, where:

the drill string washout is characterized by at least one washout opening in the drill string; and the location of the at least one washout opening is identified by at least a portion of the detecting material extending through the at least one washout opening in the drill string so that the detecting material is visible from an exterior of the drill string.

2. The method of claim 1, where circulating the washout detection composition through the drill string comprises pumping the washout detection composition into the drill string at the surface of the wellbore, where the washout detection composition travels downhole through the drill string, through the drill bit, and back to the surface through a return line.

3. The method of claim 1, where circulating the washout detection composition through the drill string comprises:

pumping a first volume of the washout detection composition through the drill string; and pumping a second volume of the washout detection composition through the drill string, where a time period between the first volume and the second volume is from 3 minutes to 10 minutes.

4. The method of claim 1, where determining the location of the drill string washout comprises identifying the detecting material exposed in an outer diameter of the drill string.

5. The method of claim 1, where a diameter of the detecting material is from 0.08 millimeters (mm) to 5 mm.

6. The method of claim 1, where a length of the detecting material is from 30 mm to 50 mm.

7. The method of claim 1, where the detecting material comprises synthetic materials, natural materials, or both.

8. The method of claim 7, where the detecting material comprises the synthetic materials and the synthetic materials comprise nylon, polyester, polypropylene, or combinations thereof.

9. The method of claim 7, where the detecting material comprises the natural materials and the natural materials comprise hemp, jute, wool, cotton, sisal, seagrass, or combinations thereof.

10. The method of claim 1, where the detecting material comprises manila rope.

11. The method of claim 1, where the detecting material comprises nylon wires having a diameter of from 0.08 mm to 0.1 mm.

12. The method of claim 1, where the detecting material comprises nylon strings comprising one or more filaments coupled together at one or more points along a length of the nylon string.

13. The method of claim 1, further comprising circulating the washout detection composition through the drill string at a flow rate of from 200 Gallons Per Minute (GPM) (45.4 $m^3/h$) to 400 GPM (90.8 $m^3/h$).

14. The method of claim 1, where the carrier fluid comprises drilling mud, viscous brine, or combinations of these.

15. The method of claim 1, where the washout detection composition comprises from 1 weight percent (wt. %) to 50 wt. % the detecting material based on total weight of the washout detection composition passed to the drill string.

16. The method of claim 1, further comprising:

recovering the washout detection composition from the wellbore; and separating a remaining portion of the detecting material from the washout detection composition for recycling.

17. The method of claim 1, where identifying the drill string washout further comprises:

identifying a change in the wellbore drilling operating condition indicative of the drill string washout, where the circulating of the washout detection composition through the drill string is conducted in response to identifying a change in the wellbore drilling operating condition indicative of a drill string washout.

18. The method of claim 17, where the operating condition comprises a pressure drop, a flow rate, a temperature, a pressure, a viscosity, or combinations thereof, of drilling fluids circulated through the drill string during operation of the drill bit.

19. The method of claim 1, where the detecting material comprises nylon strings having a diameter of from 3 mm to 5 mm and a length of from 30 mm to 50 mm, where the washout detection composition comprises from 1 weight percent (wt. %) to 50 wt. % the detecting material based on total weight of the washout detection composition passed to the drill string, and where the carrier fluid comprises drilling mud, viscous brine, or combinations of these.

* * * * *